US008639140B2

(12) United States Patent
Miyahara

(10) Patent No.: US 8,639,140 B2
(45) Date of Patent: Jan. 28, 2014

(54) IMAGE FORMING APPARATUS

(75) Inventor: Kensuke Miyahara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 131 days.

(21) Appl. No.: 13/362,347

(22) Filed: Jan. 31, 2012

(65) Prior Publication Data

US 2012/0195616 A1 Aug. 2, 2012

(30) Foreign Application Priority Data

Jan. 31, 2011 (JP) ..... 2011-017577

(51) Int. Cl.
*G03G 15/06* (2006.01)

(52) U.S. Cl.
USPC ..... 399/55

(58) Field of Classification Search
USPC ..... 399/53, 55
See application file for complete search history.

(56) References Cited

U.S. PATENT DOCUMENTS

| | | | | |
|---|---|---|---|---|
| 6,738,585 | B2 * | 5/2004 | Shin et al. | 399/26 |
| 7,620,335 | B2 | 11/2009 | Inukai | |
| 7,684,714 | B2 | 3/2010 | Kamoshida | |
| 2007/0147858 | A1 | 6/2007 | Inukai | |
| 2007/0264034 | A1 | 11/2007 | Kamoshida | |
| 2009/0175639 | A1 * | 7/2009 | Taguchi et al. | 399/49 |
| 2010/0080592 | A1 | 4/2010 | Hamaya et al. | |

FOREIGN PATENT DOCUMENTS

| | | |
|---|---|---|
| JP | 62-197150 | 12/1987 |
| JP | 03-089264 A | 4/1991 |
| JP | 04-251876 | 9/1992 |
| JP | 05-224522 | 9/1993 |
| JP | 06-118776 | 4/1994 |
| JP | 2006-003815 | 1/2006 |
| JP | 2007-162801 A | 6/2007 |
| JP | 2007-171461 | 7/2007 |
| JP | 2007-178595 | 7/2007 |
| JP | 2007-304231 A | 11/2007 |
| JP | 2007-316147 A | 12/2007 |
| JP | 2010-079045 | 4/2010 |
| JP | 2010-186203 | 8/2010 |
| JP | 2011-180556 A | 9/2011 |

OTHER PUBLICATIONS

Decision to Grant issued in Japanese Patent Application No. 2011-017577 dated Jan. 22, 2013.
Pending U.S. Appl. No. 13/071,954, filed Mar. 25, 2011.
Pending U.S. Appl. No. 13/194,075, filed Jul. 29, 2011.
Pending U.S. Appl. No. 13/069,549, filed Mar. 23, 2011.

* cited by examiner

*Primary Examiner* — G. M. Hyder
(74) *Attorney, Agent, or Firm* — Banner & Witcoff, Ltd.

(57) ABSTRACT

An image forming apparatus includes first photosensitive members, first chargers for charging the first photosensitive members, developer carriers for supplying developer to the first photosensitive members, a first charging-bias applying unit that applies charging biases to the first chargers, development-bias applying units for applying development biases to the corresponding developer carriers, a charging-current sensing unit that separately senses a charging current flowing in each of the first chargers, and a control unit that controls the development biases based on the sensed charging current. When a difference between a reference charging-current value and a detected charging-current value exceeds a predetermined value, if the detected charging-current value is larger than the reference charging-current value, the control unit increases an absolute value of a development bias applied to a developer carrier corresponding to the charger having the difference exceeding the predetermined value.

6 Claims, 6 Drawing Sheets

IMAGE FORMING APPARATUS

CROSS-REFERENCE TO RELATED APPLICATIONS

This application claims priority from Japanese Patent Application No. 2011-017577 filed on Jan. 31, 2011, the entire subject matter of which is incorporated herein by reference.

TECHNICAL FIELD

The present invention relates to an image forming apparatus capable of forming color images.

BACKGROUND

There have been proposed an image forming apparatus capable of forming color images, including a plurality of photosensitive drums disposed in parallel, scorotron chargers provided to respectively correspond to the photosensitive drums, scanner units, developing rollers, and so on.

In this image forming apparatus, the scorotron chargers, to which charging bias is applied, uniformly charge surfaces of the photosensitive drums, and then the scanner unit exposes the surfaces of the photosensitive drums, so that electrostatic latent images are formed on the photosensitive drums. Then, developers are supplied from the developing rollers, to which development bias is applied, onto the photosensitive drums having the electrostatic latent images, such that the electrostatic latent images are visualized, that is, developer images are formed on the photosensitive drums. Next, the developer images formed on the photosensitive drums are transferred onto a sheet, and the transferred image is fixed to the sheet by heat, so that the image is formed on the sheets.

SUMMARY

Illustrative aspects of the present invention provide an image forming apparatus which is capable of suppressing a reduction in image quality while using a common charging-bias applying unit.

DETAILED DESCRIPTION

<General Overview>

Figure 1:
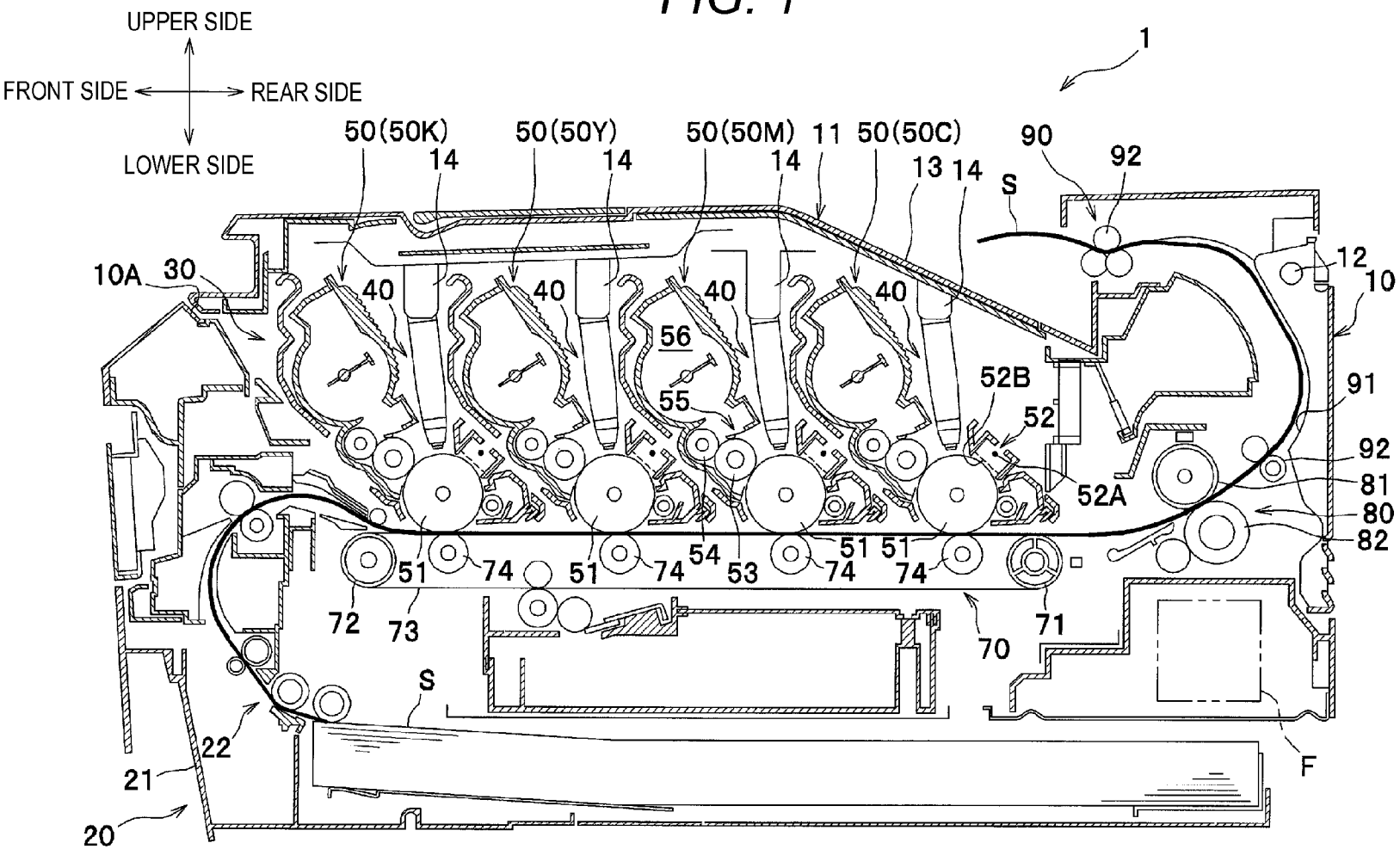
FIG. 1 is a view schematically illustrating are image forming apparatus according to a first exemplary embodiment.

Recently, in order to reduce a cost and size of an image forming apparatus, it has been considered to make a plurality of chargers share a charging-bias applying unit for applying a charging bias to the chargers. However, in a case of using the common charging-bias applying unit, since it becomes difficult to control a charging bias for each charger, for example, if one of the plurality of chargers is cleaned or one process cartridge (charger) is replaced with a new one, a difference in discharged capacity may occur between the plurality of chargers so that image quality may be degraded.

Therefore, illustrative aspects of the present invention provide an image forming apparatus which is capable of suppressing a reduction in image quality while using a common charging-bias applying unit.

According to one illustrative aspect of the present invention, there is provided an forming apparatus comprising: a plurality of first photosensitive members; a plurality of first chargers provided to correspond to the plurality of first photosensitive members, respectively, wherein the plurality of first chargers is configured to charge the corresponding first photosensitive members by corona discharge currents; a plurality of developer carriers provided to correspond to the plurality of first photosensitive members, respectively, wherein the plurality of developer carriers is configured to supply developer to the corresponding first photosensitive members; a first charging-bias applying unit connected to the plurality of first chargers, wherein the first charging-bias applying unit is configured to apply charging biases to the plurality of first chargers; a plurality of development-bias applying units provided to correspond to the plurality of developer carriers, respectively, wherein the plurality of development-bias applying units is configured to apply development biases to the corresponding developer carriers; a charging-current sensing unit configured to separately sense a charging current flowing in each of the first chargers; and a control unit configured to control the development biases on a basis of the sensed result of the charging-current sensing unit, wherein, in a case where a difference between a reference charging-current value and a detected charging-current value detected by the charging-current detecting unit exceeds a predetermined value, if the detected charging-current value is larger than the reference charging-current value, the control unit increases an absolute value of a development bias to be applied to a developer carrier corresponding to the charger having the difference exceeding the predetermined value.

According thereto, in a case where there is any charger, having the difference between the detected charging-current value and the reference charging-current value exceeding the predetermined value, among the plurality of chargers, if the detected charging-current value is larger than the reference charging-current value, the control unit increases the absolute value of a development bias to be applied to a developer carrier corresponding to the charger having the difference between the reference charging-current value and the detected charging-current value exceeding the predetermined value. Therefore, it may be possible to suppress a degradation in image quality while commonalizing a charging-bias applying unit.

More specifically, one photosensitive member charged by a charger, in which the difference exceeds the predetermined value and the detected charging-current value (absolute value) is larger than the reference charging-current value (absolute value), has a potential (absolute value) of the charged surface higher than those of other photosensitive members. Therefore, the surface potential after exposing also increases. In this case, if the development bias to be applied to the developer carrier corresponding to the one photosensitive member is controlled like previous control, it is difficult for the developer to move from the developer carrier to the one photosensitive member. As result, the developer image transferred from the one photosensitive member may get thinner, so that the quality of the entire image may be degraded.

In the image forming apparatus of the present invention, in a case where the surface potential of one photosensitive member becomes high, the absolute value of the development bias to be applied to a corresponding developer carrier increases. Therefore, it may be possible to easily move the developer from the developer carrier to the one photosensitive member. Accordingly, it may be possible to suppress the transferred developer image from getting thinner. As a result, it may be possible to suppress a degradation in image quality while using a charging-bias applying unit common to a plurality of chargers.

Incidentally, since developers which are used in an image forming apparatus capable of forming a color image have different from each other in charged performance, the developers are different from each other in their optimal development biases. Therefore, in the image forming apparatus capable of forming a color image, it is general that a development-bias applying unit is not communalized. The present invention uses the above-described development-bias applying unit to separately control the development biases. Therefore, it nay be possible to suppress a degradation in image quality while communalizing a charging-bias applying unit.

According to the present invention, in a case where the difference between the detected charging-current value and the reference charging-current value of a charger exceeds the predetermined value, if the detected charging-current value is larger than the reference charging-current value, the absolute value of a development bias to be applied to a developer carrier corresponding to the charger having the difference between the reference charging-current value and the detected charging-current value exceeding the predetermined value is increased. Therefore, it may be possible to suppress a degradation in image quality while commonalizing a charging-bias applying unit.

Exemplary Embodiments

Exemplary embodiments of the invention will now be described with reference to the drawings.

First Exemplary Embodiment

Hereinafter, a first exemplary embodiment of the present invention will be described in detail with reference to appropriate drawings. In the following description, the schematic configuration of an image forming apparatus 1 will be first described as an example of an image forming apparatus, and then the detailed configuration of the image forming apparatus 1 regarding a characterizing portion of the present invention will be described. Incidentally, a color printer is one example of the image forming apparatus 1.

Further, in the following description, directions will be described as directions relative to a user which uses the image forming apparatus 1. That is, the left side, the right side, the front side, and the rear side of FIG. 1 are the front side, the rear side, the right side, anal the left side relative to the user. Further, the vertical direction of FIG. 1 is the vertical direction relative to the user.

(Overall Configuration of Image Forming Apparatus)

As shown in FIG. 1, the image forming apparatus 1 includes a body casing an upper cover 11 (cover), a sheet feeding unit 20 for feeding sheets S, an image forming unit 30, and a sheet discharging unit 90 for discharging sheets S having images formed thereon.

The upper cover 11 is provided at an upper portion of the body casing 10 such that the front side is rotatable up and down with respect to the body caging 10 around a rotation shaft 12, so as to open and close an opening 10A formed at the top face of the body casing 10. The opening 10A is for maintenance of members contained in the body casing 10.

Specific examples of the maintenance of the internal members include replacing a process unit 50 (a charger 52) (to be described later) with a new one, cleaning the charger 52 (a wire electrode 52A), and so on. Specific methods and configurations for cleaning the charger 52 are known, and thus will not be described in detail in this specification.

The sheet feeding unit 20 is provided at a lower portion of the body casing 10. The sheet feeding unit 20 includes a sheet feed tray 21 for accommodating sheets S, and a sheet feeding mechanism 22 for feeding a sheet S from the sheet feed tray 21 to the image forming unit 30. The sheets S in the sheet feed tray 21 are separately fed to the image forming unit 30, one at a time.

The image forming unit 30 includes four LED units 40, four process units 50, a transfer unit 70, and a fixing unit 80.

The LED units 40 are supported by holding units 14 on the upper cover 11, so as to be swingable, and are disposed to face the upper sides of the photosensitive drums 51 when the upper cover 11 is closed. The LED units 40 have light emitting units (LED) provided at the fore ends. After the photosensitive drums 51 are charged, the light emitting units are flickered on the basis of image data so as to expose the surfaces of the photosensitive drums 51.

The process units 50 are disposed in parallel along the front-rear direction between the upper cover 11 and the sheet feed tray 21, and are installable and removable (replaceable) in the substantially vertical direction with respect to the body casing 10, through the opening 10A of the body casing 10 which is exposed when the upper cover 11 is opened.

Each of the process units 50 includes a photosensitive drum 51 (one example of a photosensitive member), a charger 52, a developing roller 53 (one example of a developer carrier), a feed roller 54, a layer-thickness regulating blade 55, and a toner container 56 for accommodating toner (one example of developer) which is positively charged. The process units 50 have substantially the same configuration except for the colors of the toners which are accommodated in the toner containers 56.

The photosensitive drums 51 are known photosensitive members each of which has a photosensitive layer formed on the surface (outer circumferential surface) of a cylindrical conductive main drum body, and a rotation shaft which passes through the main drum body and is grounded.

The chargers 52 are provided to correspond to the photosensitive drums 51, respectively. The chargers 52 include wire electrodes 52A and grid electrodes 52B. If a charging bias is applied, each of the chargers 52 creates corona discharge current, so as to charge the surface of a corresponding photosensitive drum 51 to a positive potential that is higher than a development bias applied to a corresponding developing roller 53.

The developing rollers 53 are provided to correspond to the photosensitive drums 51, respectively, and carry the toners on their surfaces. When each of the developing rollers 53 comes into slide contact with a corresponding photosensitive drum 51, with a positive development bias applied to the corresponding developing roller 53, the corresponding developing roller 53 supplies the toner to the corresponding photosensitive drum 51 (a portion of the surface of the corresponding photosensitive drum 51 having been exposed to having a surface potential lower than the development bias).

The transfer unit 70 is provided between the sheet feed tray 21 and the process units 50. The transfer unit 70 includes a drive roller 71, a driven roller 72, an endless of conveyance belt 73 stretched between the drive roller 71 and the driven roller 72, and four transfer rollers 74. The conveyance belt 73 contacts the photosensitive drums 51, and an inner surface of the conveyance belt 73 is nipped by the transfer rollers 74 and the photosensitive drums 51, such that an outer surface thereof contacts the photosensitive drums 51.

The fixing unit 80 is provided on the rear side relative to the process units 50 and the transfer unit 70. The fixing unit 80 includes a heating roller 81, and a pressing roller 82 which is disposed to face the heating roller 81 and press the heating roller 81.

In the image forming unit 30, the surfaces of the photosensitive drums 51 are uniformly charged by the chargers 52, and are exposed by the LED units 40, so that the electrostatic latent images based on the image data are formed on the photosensitive drums 51.

Then, the toners in the toner containers 56 is supplied to the developing rollers 53 through the feed rollers 54, and is carried as a thin layer having a uniform thickness on the developing rollers 53 between the developing rollers 53 and the layer-thickness regulating blades 55. In this procedure, the toners are triboelectrically and positively charged between the developing rollers 53 and the feed rollers 54 and between the developing rollers 53 and the layer-thickness regulating blades 55.

Then, the toners carried on the developing rollers 53 are supplied to the exposure portions of the photosensitive drums 51, so that the electrostatic latent images are visualized, that is, the toner images are formed on the photosensitive drums 51. Next, a sheet S fed from the sheet feeding unit 20 is conveyed between the photosensitive drums 51 and the conveyance belt 73 (transfer rollers 74 having a transfer bias applied thereto), such that the toner images on the photosensitive drums 51 are transferred onto the sheet S. The sheet S having the transferred toner image is conveyed between the heating roller 81 and the pressing roller 82, and the toner image is thermally fixed.

Incidentally, in the image forming apparatus 1, in a case of forming a color image, toner images are formed on the photosensitive drums 51 of all of the process units 50. Then, when a sheet S is conveyed between the photosensitive drums 51 and the conveyance belt 73, the toner images of different colors are sequentially transferred onto the sheet S to overlap. On the other hand, in a case of forming a monochrome image with a black toner, a toner image is formed on the photosensitive drum 51 of the process unit 50 which accommodates the black toner. Then, when a sheet S is conveyed between the photosensitive drums 51 and the conveyance belt 73, the black toner image is transferred onto the sheet S.

The sheet discharging unit 90 includes a sheet discharge path 91 for guiding each sheet S conveyed from the fixing unit 6, and a plurality of conveyance rollers 93 for conveying the sheet S. The sheet S having the toner image fixed thereto by heat (sheet S having the image formed thereon) is conveyed through the sheet discharge path 91 by the conveyance rollers 93, and is discharged to the outside of the body casing 10 and be loaded on a sheet discharge tray 13.

(Detailed Configuration of Image Forming Apparatus)

Figure 2:
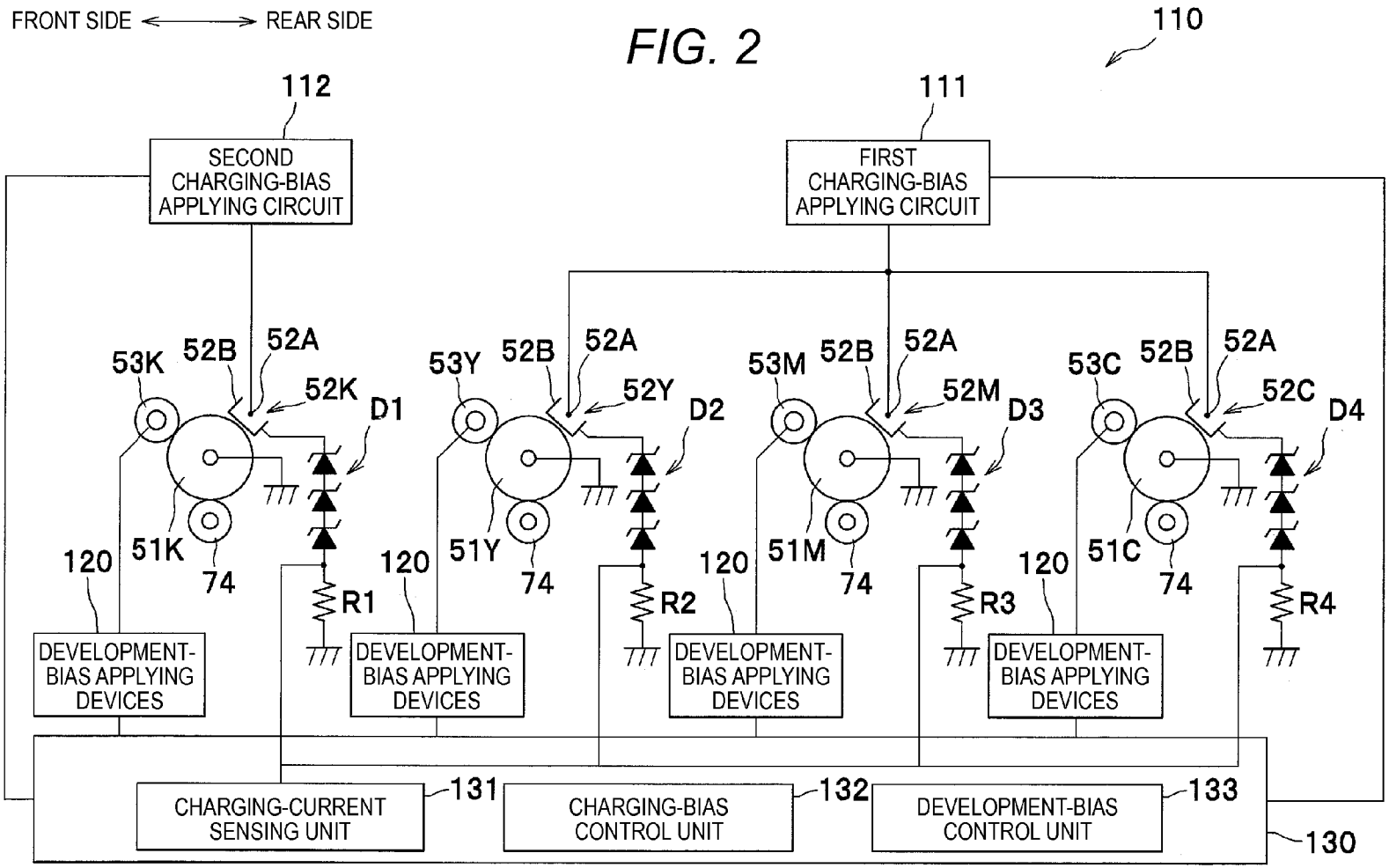
FIG. 2 is a view illustrating a configuration regarding a characterizing portion of the image forming apparatus according to the first exemplary embodiment.

As shown in FIG. 2, the image forming apparatus 1 further includes a charging-bias applying device 110, four development-bias applying devices 120 (one example of a plurality of development-bias applying unit), and a control device 130.

In the present exemplary embodiment, the photosensitive drum 51K and the charger 52K of the process unit 50 (50K) accommodating the black toner are one example of a second photosensitive member and a second charger, respectively. The photosensitive drums 51Y, 51M, and 51C and the chargers 52Y, 52M, and 52C of the process units 50 (50Y, 50M, and 50C) accommodating the yellow lack toner, the magenta toner, and the cyan toner are one example of a plurality of first photosensitive members and a plurality of first chargers, respectively.

The charging-bias applying device 110 includes a first charging-bias applying circuit 111 (one example of a first charging-bias applying unit), a second charging-bias applying circuit 112 (one example of a second charging-bias applying unit), four voltage regulator circuits D1, D2, D3, and D4, and four current detectors R1, R2, R3, and R4.

The first charging-bias applying circuit 111 is connected to the wire electrodes 52A of the chargers 52Y, 52M, and 52C, and applies a common charging bias (voltage) to the chargers 52Y, 52M, and 52C. The second charging-bias applying circuit 112 is connected to the wire electrode 52A of the chargers 52K, and applies a charging bias to the charger 52K.

In the present exemplary embodiment, since the first charging-bias applying circuit 111 is connected to the chargers 52Y, 52M, and 52C, and the second charging-bias applying circuit 112 is connected only to the charger 52K, it is possible to individually control the charging bias to be applied to the charger 52K. The specific configurations and the like of the circuits for applying the charging bias to the chargers 52 are known and thus will not be described in detail in this specification.

Each of the voltage regulator circuits D1 to D4 may be composed of three Zener diodes connected in series, and is for maintain the voltage to be applied to the grid electrode 52B of a corresponding charger 52, at a constant voltage. Each of the current detectors R1 to R4 may be composed of a resistor, such that one end thereof is connected to a corresponding one of the voltage regulator circuits D1 to D4, and the other end thereof is grounded.

The development-bias applying devices 120 are provided to correspond to the developing rollers 53 of the process units 50, respectively, and are connected to the corresponding developing rollers 53. Each of the development-bias applying devices 120 applies a development bias (voltage) according to the color (charged performance) of the toner which is carried on a corresponding developing roller 53. The specific configurations and the like of the devices for applying the charging biases to the developing rollers 53 are known and thus will not be described in detail in this specification.

The control device 130 is configured to include a CPU, a RAM, a ROM, an input/output interface, and so on (not shown), and controls each of the components of the image forming apparatus 1, such as the charging-bias applying device 110 and the development-bias applying devices 120, in accordance with a predetermined program or the like. The control device 130 is a function unit related to the present invention, and includes a charging-current detecting unit 131, a charging-bias control unit 132, and a development-bias control unit 133 (one example of a control unit).

The charging-current detecting unit 131 has a function of individually detecting a charging current flowing each of the chargers 52. Specifically, the charging-current detecting unit 131 is connected between each of the voltage regulator circuits D1 to D4 and a current detector R1, R2, R3, or R4 corresponding to the corresponding voltage regulator circuit, so as to receive a voltage proportional to the magnitude of the charging current flowing in the grid electrode 52B of each charger 52. Therefore, the charging-current detecting unit 131 can read the received voltage, so as to detect the charging current flowing in each charger 52.

The charging-bias control unit 132 has a function of controlling the first charging-bias applying circuit 111 and the second charging-bias applying circuit 112 on the basis of the detection results of the charging-current detecting unit 131 such that the charging biases to be applied to the chargers 52 are controlled. Specifically, the charging-bias control unit 132 controls the charging biases by constant current control. The specific methods for controlling the charging biases are known and thus will not be described in detail in this specification.

The development-bias control unit 133 has a function of controlling each of the development-bias applying devices 120 on the basis of the detection results of the charging-current detecting unit 131 such that the development biases to be applied to the developing rollers 53 are controlled.

More specifically, in an idle rotation operation which is performed when print job including an instruction to start image formation, data (image data) of an image to be formed on a sheet S, and the like is input, the development-bias control unit 133 performs the following process.

First, the development-bias control nit 133 acquires the charging current (detected charging-current value I(n)) of each charger 52 detected by the charging-current detecting unit 131, and stores the charging current in the RAM. In this case, the development-bias control unit 133 reads the detected charging-current value I(n−1) acquired (stored) when the previous print job was input, from the RAM, and sets the detected charging-current value I(n−1) as a reference charging-current value IB.

Next, in a case where a difference ΔI (absolute value) between the reference charging-current value IB and any one of the detected charging-current values I(n) of the chargers 52 exceeds a predetermined value Ith (ΔI>IB), if the corresponding detected charging-current value I(n) is larger than the reference charging-current value IB (I(n)>IB), the development-bias control unit 133 increases the development bias (set voltage) to be applied to a developing roller 53 corresponding to the charger 52 having the difference ΔI larger than the predetermined value Ith.

In the case where the difference ΔI exceeds the predetermined value. Ith, if the corresponding detected charging-current value I(n) is smaller than the reference charging-current value IB (I(n)<IB) the development-bias control unit 133 increases the development bias (set voltage) to be applied to a developing roller 53 corresponding to the charger 52 having the difference ΔI larger than the predetermined value Ith.

Further, the development-bias control unit 133 does not change the development bias (set voltage) to be applied to a developing roller 53 corresponding to each charger 52 having the difference ΔI equal to or smaller than the predetermined value Ith (that is, the development-bias control unit 133 sets the same development bias as that applied when the previous print job was input and an image was formed on a sheet S (during the previous image forming operation)).

Then, the development-bias control unit 133 controls the development-bias applying devices 120 such that the development biases set for the developing rollers 53 are applied to the developing rollers 53.

in the image forming apparatus 1 according to the present exemplary embodiment, the set development biases are applied to the developing rollers 53 and then an image forming operation (for example, feeding a sheet S, charging the photosensitive drums 51, and so on) starts.

The idle rotation operation is an operation of preliminarily rotating the photosensitive drums 51, the developing rollers 53, the feed rollers 54, and the like, after a print job is input (before an image forming operation) or when the upper cover 11 is closed.

Figure 3:
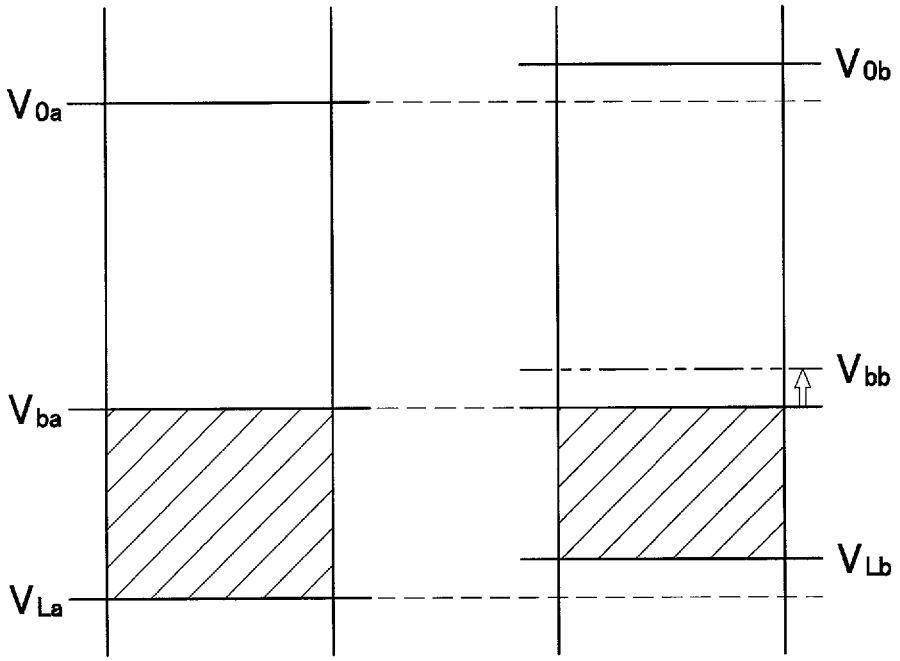
FIG. 3 is a view for explaining an effect of an increase in a development bias.
Figure 4:
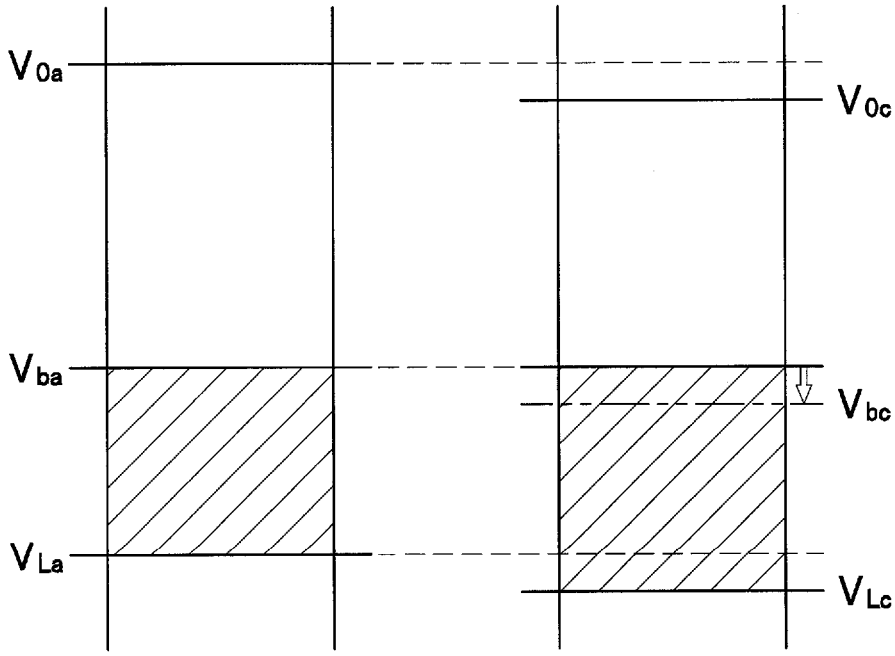
FIG. 4 is a view for explaining an effect of a decrease in the development bias.

Effects of an increase or decrease in development bias will now be described with reference to FIGS. 3 and 4.

For example, when the wire electrode 52A of one of the chargers 52Y, 52M, and 52C is cleaned, the cleaned wire electrode 52A has electrical resistance smaller than those of the other wire electrodes 52A, so that discharge capacity in a case where a common constant current is applied increases. In this case, as shown in FIG. 3, the surface potential V0*b* of the photosensitive drum 51 after charging increases as compared to a surface potential V0*a* before the cleaning, and the surface potential VLb of the photosensitive drum 51 after exposing also increases.

When the difference between the surface potential V0*a* and the surface potential V0*b* is equal to or greater than a predetermined value, if the development bias Vba is applied to a corresponding developing roller 53, the area of a hatched region decreases. This means a decrease in the amount of toner which moves from the developing roller 53 to a corresponding photosensitive drum 51. In this case, a toner image transferred from the photosensitive drum 51 having the small amount of fed toner onto a sheets S gets thinner, that is, the toner image of one color of yellow, magenta, and cyan gets thinner. Therefore, the quality of the entire image is degraded.

Thus, in the present exemplary embodiment, when the surface potential of a charged photosensitive drum 51 rapidly increases, that is, when (ΔI>Ith) and (I(n)>IB) are satisfied, a development bias to be applied to a developing roller 53 corresponding to a charger 52 having the difference ΔI exceeding the predetermined value Ith is increased (from Vba to Vbb) to secure the amount of toner to move from the corresponding developing roller 53 to a corresponding photosensitive drum 51. Therefore, it is possible to suppress a transferred image on a sheet S from becoming thin.

On the other hand, when the electrical resistance of the wire electrode 52A of one of the chargers 52Y, 52M, and 52C is larger than those of the other wire electrodes 52A, if a common constant current is applied, the discharge capacity decreases. In this case, as shown in FIG. 4, the surface potential V0*c* of a corresponding photosensitive drum 51 after charging decreases, and the surface potential VLc of the corresponding photosensitive drum 51 after exposing also decreases.

When the difference between the surface potential V0*a* and the surface potential V0*c* is equal to or greater than a predetermined value, if a development bias Vba is applied, the area of a hatched region increases. This means an increase in the amount of toner which moves from the developing roller 53 to a corresponding photosensitive drum 51. In this case, the toner image of one color of yellow, magenta, and cyan gets thicker, and thus the quality of the entire image is degraded.

In the present exemplary embodiment when the surface potential of a charged photosensitive drum 51 rapidly decreases, that is, when (ΔI>Ith) and (I(n)<IB) are satisfied, a development bias to be applied to a developing roller 53 corresponding to a charger 52 having the difference ΔI exceeding the predetermined value Ith is decreased (from Vba to Vbc) to suppress the amount of toner to move from the corresponding developing roller 53 to a corresponding photosensitive drum 51. Therefore, it is possible to suppress a degradation in image quality.

The above-described development-bias control flow will be described with reference to FIG. 5.

Figure 5:
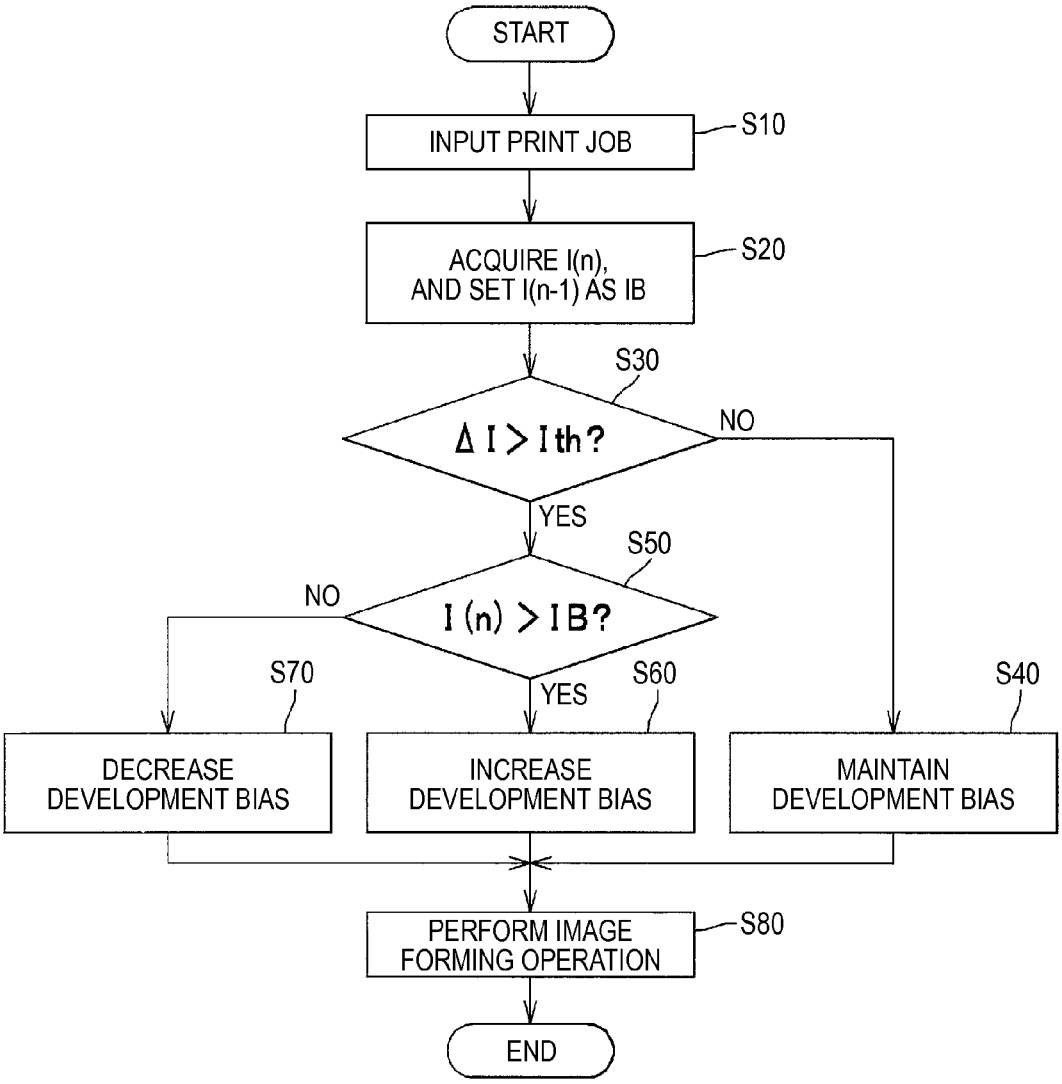
FIG. 5 is a flow chart illustrating control on the development bias according to the first exemplary embodiment.

As shown in FIG. 5, if a print job is input in STEP S10, in STEP S20, the control device 130 performs the idle rotation operation, acquires the detected charging-current values I(n) of the chargers 52, and sets the detected charging-current values I(n−1) acquired when the previous print job was input, as the reference charging-current values IB.

Next, in STEP S30, the control device 130 determines whether the difference ΔI between the reference charging-current value IB and the detected charging-current value I(n) of each of the chargers 52 exceeds the predetermined value Ith. Then, for example, in a case where the difference ΔI does not exceed the predetermined value Ith in the chargers 52K and 52M shown in FIG. 2 (No in STEP S30), in STEP S40, the control device 130 sets the development biases (set voltages) to be applied to the developing rollers 53K and 53M, to the same values as those in the previous image forming operation (the development biases are not changed).

On the other hand, for example, in a case where the difference ΔI exceeds the predetermined value Ith in each of the chargers 52Y and 52C shown in FIG. 2 (YES in STEP S30), in STEP S50, the control device 130 determines whether the detected charging-current value I(n) is larger than the reference charging-current value IB for each charger. Then, for example, in a case where the detected charging-current value I(n) is larger than the reference charging-current value IB for the charger 52C (Yes in STEP S50), in STEP S60, the control device 130 sets the development bias (set voltage) to be applied to the developing roller 53C, to a large value (the development bias is increased).

On the other hand, for example, in a case where the detected charging-current value I(n) is not larger than the reference charging-current value IB for the charger 52Y (No in STEP S50), in STEP S70, the control device 130 sets the development bias (set voltage) to be applied to the developing roller 53Y, to a small value (the development bias is decreased).

Next, in STEP S80, the control device 130 controls the development-bias applying devices 120 such that the development biases (set voltages) set in STEPS S40, S60, and S70 are applied to the developing rollers 53, to perform an image forming operation. Then, if the image forming operation finishes, the control device 130 finishes the process (END).

According to the above-described process, it is possible to obtain the following effects in the present exemplary embodiment.

In a case where there is any charger 52, having the difference ΔI between the detected charging-current value I(n) and the reference charging-current value IB exceeding the predetermined value Ith, among the plurality of chargers 52, if the corresponding charger 52 satisfies (I(n)>IB), the development-bias control unit 133 increases the development bias to be applied to a developing roller 53 corresponding to the charger 52 having the difference ΔI exceeding the predetermined value Ith. Therefore, it is possible to suppress a toner image of one color from getting thinner so as not to degrade the image quality.

Further, in a case where the difference ΔI between the reference charging-current value IB and the detected charging-current value I(n) of a charger exceeds the predetermined value Ith, if the charger satisfies (I(n)<IB), the development-bias control unit 133 decreases the development bias to be applied to a developing roller 53 corresponding to the charger 52 having the difference ΔI exceeding the predetermined value Ith. Therefore, it is possible to suppress a toner image of one color from getting thicker so as not to degrade the image quality.

Further, since originally unshared four development-bias applying devices 120 are individually controlled such that a degradation in image quality is suppressed, it is possible to make the first charging-bias applying circuit 111 common to the chargers 52Y, 52M and 52C. Therefore, it is possible to reduce the cost and size of the image forming apparatus 1.

When a print job is input, the development-bias control unit 133 acquires the detected charging-current values I(n), and sets the detected charging-current values I(n−1) acquired when the previous print job was input, as the reference charging-current values IB. Therefore, it is possible to reliably suppress a degradation in image quality, particularly after cleaning. Specifically, since cleaning on a charger 52 is performed when the image forming apparatus 1 is at a stop, that is, between a print job and another print job, if the development-bias control starts when a print job is input, it is possible to reliably suppress a degradation in image quality after cleaning or the like.

Since the second charging-bias applying circuit 112 for applying the charging bias to the charger 52K corresponding to the black toner is provided separately from the first charging-bias applying circuit 111, it is possible to separately control the charging bias to be applied to the charger 52K which is frequently used and of which the wire electrode 52A easily gets dirty. Therefore, it is possible to apply the optimal charging bias according to the polluted state of each charger 52 (wire electrode 52A). Further, in a case of forming a monochrome image, the first charging-bias apply circuit 111 may stop (or the currents flowing in the chargers 52Y, 52M, and 52C may be decreased). In this case, it is possible to save the energy consumption of the image forming apparatus 1.

Second Exemplary Embodiment

A second exemplary embodiment of the present invention will now be described. Incidentally, in the following description, components and processes identical to those of the above-described first exemplary embodiment are denoted by the same reference symbols, and will be described in brief or will not be described.

An image forming apparatus 1 according to the second exemplary embodiment includes a known opening/closing sensor (not shown) for sensing whether an upper cover 11 is opened or closed. In a case where the opened upper cover 11 is closed, a development-bias control unit 133 (control device 130) of the second exemplary embodiment determines whether the difference ΔI between the reference charging-current value IB and the detected charging-current value I(n) of each charger exceeds the predetermined value Ith (whether to start development-bias setting control).

Figure 6:
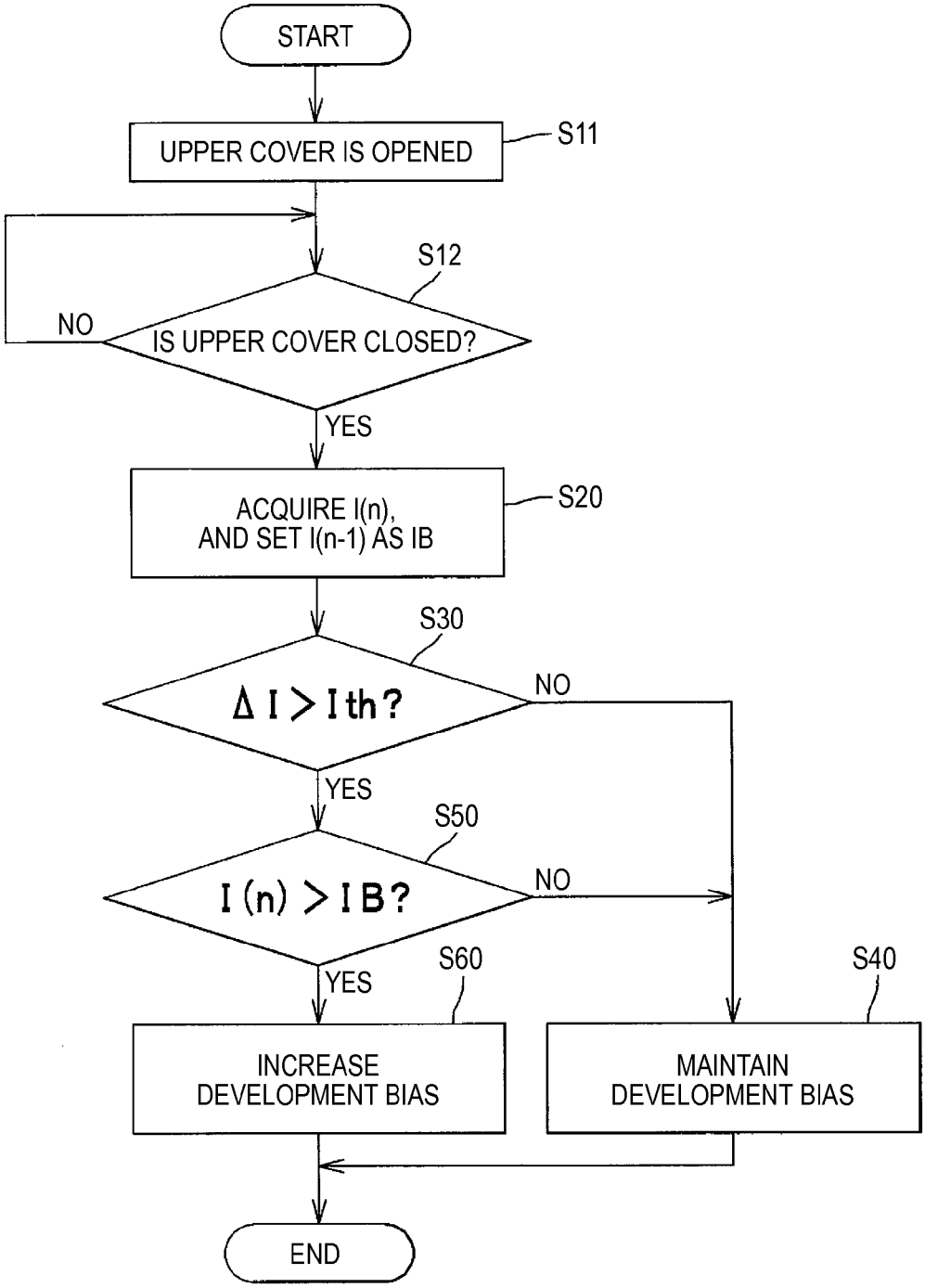
FIG. 6 is a flow chart illustrating control on a development bias according to a second exemplary embodiment.

Specifically, as shown in FIG. 6, when the upper cover 11 is opened in STEP S11, in STEP S12, the control device 130 monitors whether the upper cover 11 is closed. If the upper cover 11 is closed (Yes in STEP S12), STEP S20 identical to that of the above-described first exemplary embodiment is performed. Next in STEP S30, it is determined whether the difference ΔI between the reference charging-current value IB and the detected charging-current value I(n) of each charger 52 exceeds the predetermined value Ith.

If the difference ΔI of the corresponding charger 52 does not exceed the predetermined value Ith (No in STEP S30), in STEP S40, the control device 130 does not change the development bias to be applied to a developing roller 53 corresponding to the corresponding charger 52. On the other hand, if the difference ΔI of the corresponding charger 52 exceeds the predetermined value Ith (Yes in STEP S30), in STEP S50, the control device 130 determines whether the detected charging-current value I(n) is larger than the reference charging-current value IB.

Then, in a case where the detected charging-current value I(n) is larger than the reference charging-current value IB with respect to the corresponding charger 52 (Yes in STEP S50), in STEP S60, the control device 130 increases the development bias to be applied to a developing roller 53 corresponding to the corresponding charger 52. On the other hand, in a case where the detected charging-current value I(n) is not larger than the reference charging-current value IB with respect to the corresponding charger 52 (No in STEP S50), in STEP 540, the control device 130 does not change the development bias to be applied to a developing roller 53 corresponding to the corresponding charger 52.

After STEP S40 or S60, the control device 130 finishes the development-bias control (setting control) (END). Then, when a print job is input, the control device 130 applies the set development biases to the individual developing rollers 53, thereby performing an image forming operation.

Also in the above-described second exemplary embodiment, in a case where there is any charger 52, having the difference ΔI exceeding the predetermined value Ith, among the plurality of chargers 52, if the corresponding charger 52 satisfies (I(n)>IB), the control device 130 increases the development bias to be applied to a developing roller 53 corresponding to the charger 52 having the difference ΔI exceeding the predetermined value Ith. Therefore, it is possible to suppress a degradation in image quality while commonalizing a charging-bias applying unit.

Further, in the second exemplary embodiment, when the opened upper cover 11 is closed to clean a charger 52 or replace a process unit 50 (charger 52) with another unit, it is determined whether the difference ΔI exceeds the predetermined value Ith with respect to each charger (the development-bias setting control starts). Therefore, it is possible to reliably suppress a degradation in image quality, particularly after cleaning.

Third Exemplary Embodiment

A third exemplary embodiment of the present invention will now be described.

An image forming apparatus 1 according to the third exemplary embodiment includes a fan F for discharging internal air from inside of the body casing 10 (the image forming apparatus 1) to the outside, as shown by a chained line in FIG. 1. More specifically, the fan F is provided at the rear portion of any one of the left and right side walls of the body casing 10, on the rear side relative to the plurality of process units 50.

Figure 7:
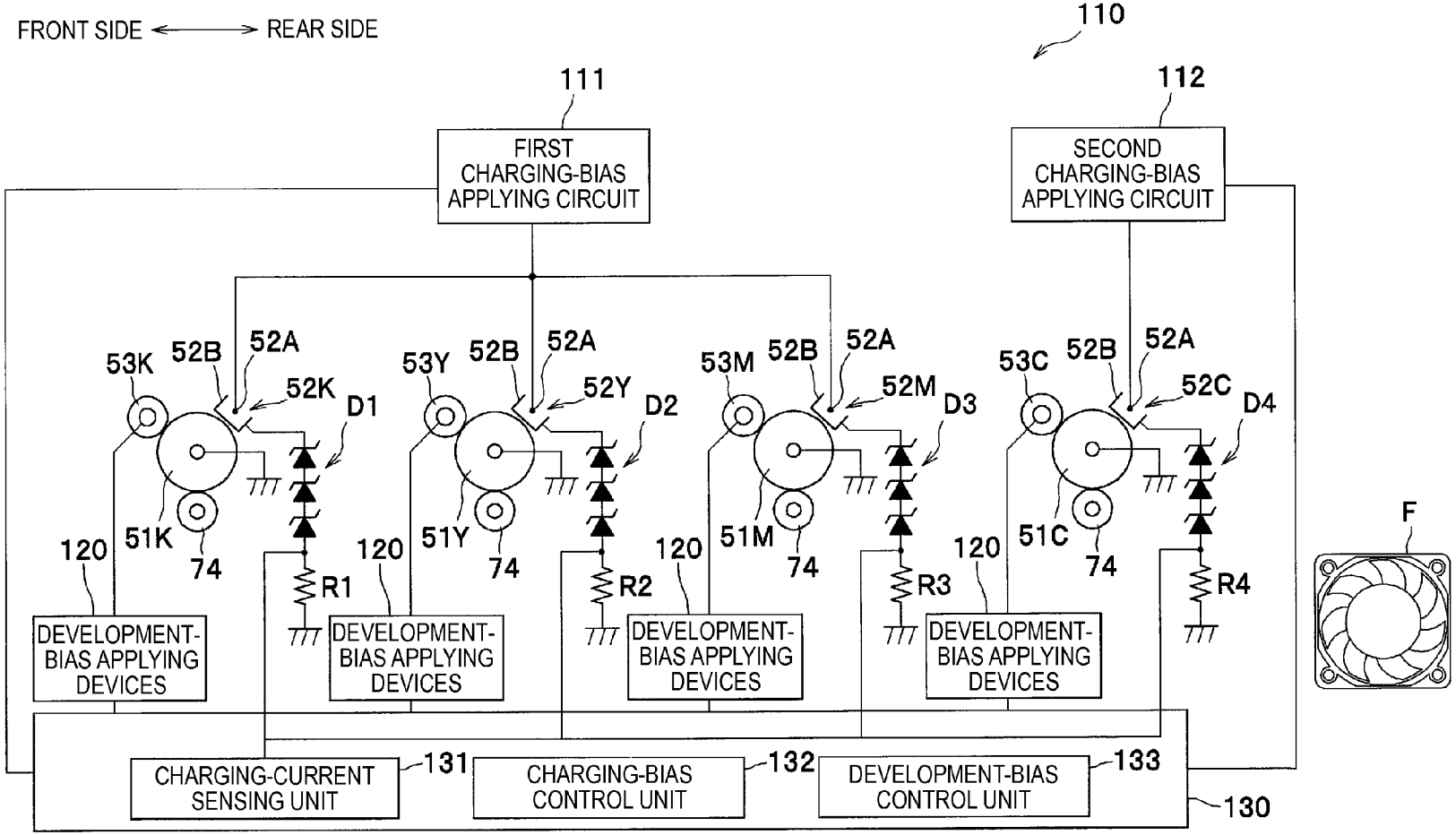
FIG. 7 is a view illustrating a configuration regarding a characterizing portion of an age forming apparatus according to a third exemplary embodiment.

In the third exemplary embodiment, the first charging-bias applying circuit 111 is connected to the wire electrodes 52A of the chargers 52K, 52Y, and 52M (one example of a plurality of first chargers), as shown in FIG. 7. Further, the second charging-bias applying circuit 112 (one example of a third charging-bias applying unit) is connected to the wire electrode 52A of the charger 52C (one example of a third charger). The wire electrode 52A is configured to charge the photosensitive drum 51C (one example of a third photosensitive member) that is disposed closer to the fan F than the photosensitive drums 51K, 51Y, and 51M (one example of a plurality of first photosensitive members).

A charging-current sensing unit 131 has a function of separately sensing the charging currents flowing in the individual chargers 52. A development-bias control unit 133 has a function of controlling the development biases, as those in the above-described first or second exemplary embodiment.

Also in the third exemplary embodiment having such a configuration, like the cases of the above-described first and second exemplary embodiments, it is possible to suppress a degradation in image quality while commonalizing the first charging-bias applying circuit 111.

Since the flow rate of the air is high around the wire electrode 52A of the charger 52C disposed closest to the fan F, the wire electrode 52A of the charger 52C is more easily polluted as compared to that of another charger 52K or the like. In the third exemplary embodiment, since the second charging-bias applying circuit 112 for applying the charging bias to the charger 52C is provided separately from the first charging-bias applying circuit 111, it is possible to apply the optimal charging bias according to the polluted state of each wire electrode 52A, to a corresponding charger 52.

Although the exemplary embodiments of the present invention have been described above, the present invention is not limited to the above-described exemplary embodiments. The specific configurations can be appropriately modified within the scope of the present invention.

flu the above-described exemplary embodiments, the charging-bias applying unit (first charging-bias applying circuit 111) is common to three of the four chargers 52. However, the present invention is not limited thereto. For example, a charging-bias applying unit may be common to all of the chargers. Alternatively, two charging-bias applying unit may be provided, and each of the charging-bias applying unit may be connected to a plurality of chargers.

In the above-described exemplary embodiments, when a print job is input, the detected charging-current values I(n) acquired when the previous print job was input are set as the reference charging-current values IB. The reference charging-current values may be a single predetermined fixed value or may be a fixed value selected from a predetermined table.

The present invention may be configured such that when a print job is input, the detected charging-current values I(n) acquired when the previous print job was input are set as the reference charging-current values IB, the development biases (set voltages) are changed, and the changed results is applied not only to the present image forming operation but also to the next image forming operation. Also, the present invention may be configured to change (control) the development bias to be applied to each developer carrier in multiple stages.

In the above-described exemplary embodiments, as the cover, the upper cover 11 for opening and closing the opening 10A formed at the top face of the body casing 10 has been exemplified. However, the present invention not limited thereto. For example, the cover may be a cover for opening and closing an opening formed at the front face of the body casing, or may be a cover for opening and closing an opening formed at the left or right face of the body casing.

In the above-described exemplary embodiments, the charging current flowing in each charger 52 is sensed at the grid electrode 52B. However, the present invention is not limited thereto. For example, the charging current flowing in each charger 52 may be sensed at the wire electrode 52A. Further, in the present invention, the specific configurations for sensing the charging currents are not limited to those shown in the above-described exemplary embodiments. It is possible to use known configurations.

In the above-described exemplary embodiments, as chargers 52, the scorotron chargers having the wire electrodes 52A and the grid electrodes 52B have been exemplified. However, the present invention is not limited thereto. In other words, in the present invention, any configuration which charges a photosensitive member by a corona discharge current may be used as the charger. For example, the charger may be a corotron charger having no grid electrode or may be a charger (pin array charger) having pin-shaped electrodes arranged in a line, instead of the wire electrode.

In the above-described exemplary embodiments, the image forming apparatus 1 has been exemplified. The image forming apparatus is not limited to the color printer. Examples of the image forming apparatus include a copy machine or a multi-function apparatus having a document reading device such as a flatbed scanner. Further, in the above-described exemplary embodiments, the image forming apparatus includes the LED units 40 having the light emitting portions provided at their fore ends, and the light emitting portions flicker to expose the photosensitive members. However, the present invention is not limited thereto. For example, the image forming apparatus may include a laser scanner for scanning the surfaces of the photosensitive members with laser beams at high speed so as to expose the photosensitive members.

In the above-described exemplary embodiments, positively-charged toner has been exemplified as the developer. However, the present invention is also applied to an image forming apparatus that uses negatively-charged toner. In such an image forming apparatus using the negatively-charged toner, negative development biases are applied to developer carriers, and the surfaces of photosensitive members are charged with a negative potential lower than the development biases. Then, toner is supplied from the developer carriers having the development biases applied thereto, to portions, having been exposed to have the potentials higher than the development biases, of the surfaces of the photosensitive members, whereby toner images are formed on the photosensitive members.

If the present invention is applied to that image forming apparatus, in a case where the difference (absolute value) between the reference charging-current value and the detected charging-current value of a charger exceeds the predetermined value, if the detected charging-current value (absolute value) is larger than reference charging-current value (absolute value), the control unit sets the negative development bias to be applied to a developer carrier corresponding to the charger having the above-described difference exceeding the predetermined value, to a small value (the absolute value of the development bias increases). Meanwhile, in a case where the difference between the reference charging-current value and the detected charging-current value of a charger exceeds the predetermined value, if the detected charging-current value is not larger than reference charging-current value, the control unit sets the negative development bias to be applied to a developer carrier corresponding to the charger having the above-described difference exceeding the predetermined value, to a large value (the absolute value of the development bias decreases).

What is claimed is:

1. An image forming apparatus comprising:

a plurality of first photosensitive members;

a plurality of first chargers provided to correspond to the plurality of first photosensitive members, respectively, wherein each of the plurality of first chargers is configured to charge a corresponding first photosensitive member by corona discharge currents;

a plurality of developer carriers provided to correspond to the plurality of first photosensitive members, respectively, wherein each of the plurality of developer carriers is configured to supply developer to a corresponding first photosensitive member;

a first charging-bias applying unit connected to the plurality of first chargers, wherein the first charging-bias applying unit is configured to apply charging biases to the plurality of first chargers;

a plurality of development-bias applying units provided to correspond to the plurality of developer carriers, respectively, wherein each of the plurality of development-bias applying units is configured to apply development biases to a corresponding developer carrier;

a charging-current sensing unit configured to separately sense a charging current flowing in each of the first chargers; and a control unit configured to control the development biases based on the sensed result of the charging-current sensing unit, wherein, in a case where a difference between a reference charging-current value and a detected charging-current value of a charger detected by the charging-current detecting unit exceeds a predetermined value, if the detected charging-current value is larger than the reference charging-current value, the control unit increases an absolute value of a development bias to be applied to a developer carrier corresponding to the charger having the difference exceeding the predetermined value.

2. The image forming apparatus according claim 1, wherein, in the case where the difference between the reference charging-current value and the detected charging-current value detected by the charging-current detecting unit exceeds the predetermined value, if the detected charging-current value is not larger than the reference charging-current value, the control unit decreases the absolute value of a development bias to be applied to a developer carrier corresponding to the charger having the difference exceeding the predetermined value.

3. The image forming apparatus according to claim 1, wherein, when a print job is input, the control unit is configured to:

acquire detected charging-current values; and set a previous detected charging-current value acquired when the previous print job was input as the reference charging-current value.

4. The image forming apparatus according to claim 1, further comprising:

a body casing comprising an opening for maintenance on members accommodated inside; and a cover configured to close and open the opening, wherein, if the opened cover is closed, the control unit determines whether the reference charging-current value and the detected charging-current value of each charger exceeds the predetermined value.

5. The image forming apparatus according to claim 1, further comprising:

a second photosensitive member corresponding to a black developer;

a second charger configured to charge the second photosensitive member by corona discharge currents;

a second developer carrier configured to supply the developer to the second photosensitive member; and a second charging-bias applying unit connected to the second charger, wherein the second charging-bias applying unit is configured to apply a charging bias to the second charger, wherein the charging-current detecting unit separately detects the charging current flowing in each of the plurality of first chargers and the second charger.

6. The image forming apparatus according to claim 1, further comprising:

a fan configured to discharge air from an inside of a body casing of the image forming apparatus to an outside thereof;

a third photosensitive member disposed closer to the fan than the plurality of first photosensitive members;

a third charger configured to charge the photosensitive member by corona discharge currents;

a third developer carrier configured to supply the developer to the third photosensitive member; and a third charging-bias applying unit connected to the third charger, wherein the third charging-bias applying unit is configured to apply a charging bias to the third charger, wherein the charging-current detecting unit separately detects the charging current flowing in each of the plurality of first chargers and the third charger.

* * * * *